United States Patent [19]

Johnson

[11] 4,185,882

[45] Jan. 29, 1980

[54] ELECTRICAL CONNECTOR FOR PRINTED CIRCUIT BOARDS OR THE LIKE

[75] Inventor: Donald L. Johnson, Olivenhain, Calif.

[73] Assignee: Teledyne Industries, Inc., Los Angeles, Calif.

[21] Appl. No.: 924,690

[22] Filed: Jul. 14, 1978

[51] Int. Cl.[2] ..... H01R 13/62
[52] U.S. Cl. ..... 339/176 MP
[58] Field of Search ..... 339/17 L, 75 MP, 176 MP

[56] References Cited

U.S. PATENT DOCUMENTS

| | | | |
|---|---|---|---|
| 3,795,888 | 3/1974 | Nardo et al. | 339/17 L |
| 3,848,952 | 11/1974 | Tighe, Jr. | 339/176 MP |
| 3,920,303 | 11/1975 | Pittman et al. | 339/176 MP |
| 4,003,625 | 1/1977 | Vladic | 339/17 L |
| 4,128,289 | 12/1978 | Occhipinti | 339/75 MP |

FOREIGN PATENT DOCUMENTS

| | | | |
|---|---|---|---|
| 866052 | 4/1961 | United Kingdom | 339/75 MP |

*Primary Examiner*—Joseph H. McGlynn
*Attorney, Agent, or Firm*—Reagin & King

[57] ABSTRACT

An electrical connector for receiving printed circuit boards or the like, the connector having a body portion having molded therein in alignment a plurality of upwardly extending and inwardly bent resilient spring contact members terminating on a common line, the body having a recessed ramp portion into which the printed circuit board may be inserted without contact and then pivoted to engage the contact members and then moved forward to a co-planar ridge for maintaining the electrical contact. The body may be provided with a pair of pins configured for engaging matingly contoured holes in the printed circuit board, the pins being engagable when the printed circuit board is moved toward the contacts upon engagement with the ridge for locking the parts in assembled relation.

9 Claims, 6 Drawing Figures

ELECTRICAL CONNECTOR FOR PRINTED CIRCUIT BOARDS OR THE LIKE

BACKGROUND OF THE INVENTION

The background of the invention will be discussed in two parts:

1. Field of the Invention

This invention relates to electrical connectors and more particularly to an electrical connector for receiving a printed circuit board of the like.

2. Description of the Prior Art

Connectors configured for receiving printed circuit boards have become increasingly common due to the technological advancements in integrated circuitry resulting in more functional circuits being placed on one chip of smaller configuration. With printed circuit boards replacing hard wired circuits, the overall height of the assembled printed circuit board has decreased to shallow dimensions. Additionally, such items as key boards and displays or the like are assembled on printed circuit boards having one edge thereof provided with a plurality of aligned conductive pads configured for engagement by spring contact members of a connector.

Such connectors may be of the two-sided connector, that is, having a receptacle for receiving the edge of the printed circuit board with aligned pairs of inwardly extending contact members being disposed within the receptacle for engaging conductive pads on both sides of the printed circuit board. Other such connectors may be of a one-sided configuration having a plastic molded connector body with contact members molded therein in aligned relation, the contact members having a generally J-shaped configuration with the long arms thereof generally perpendicular to the plane of the connector body and the curved or bent portions thereof extending inwardly and downwardly toward the connector body, the resilients of the contact members retaining the edge of the printed circuit board in position, the edge being inserted into the opening between the terminal edges of the contact members and the plane of the connector body. When sliding the printed circuit board along the plane of the connector body into the opening, a relatively high insertion force is required since the terminal edges of the contact members define a line relative to the plane of the connector body resulting in an opening between this line and the body having a height less than the thickness of the edge of the printed circuit board. Furthermore, unless this insertion is effected properly, the contact members being of relatively thin gage brass or the like are subject to deforming resulting in no contact or poor electrical contact.

It is an object of the present invention to provide a new and improved connector for receiving printed circuit boards or the like.

It is another object of the present invention to provide a low insertion force connector.

It is a further object of this invention to provide a new and improved connector having means for locking the inserted part.

SUMMARY OF THE INVENTION

The foregoing and other objects of the invention are accomplished by providing a connector having a body member with a generally elongate portion and a plurality of aligned resilient contact members extending through the body member with the terminal edges of the contact members defining a line spaced from the plane of the elongate portion to form an opening for receiving an edge of a printed circuit board or the like. The body member is provided with a tapered recess below this line for receiving the edge of the printed circuit board when displaced angularly relative to the plane of the body member, the conductive pads on the edge of the printed circuit board being spaced from the terminal ends of the contact members. Upon pivoting of the printed circuit board toward the body member the pads engage the terminal ends of the contact members to urge these ends away from the plane of the body member. A ridge portion is provided on the body member adjacent the recess, with movement of the printed circuit board edge into the opening retaining the printed circuit board edge on the ridge portion with the printed circuit board in abutting relation with the surface of the body member. In another embodiment, the body member is provided with at least a pair of pin like projections spaced from the contact members with the bottom of the printed circuit board being provided with matingly co-acting openings engagable at a predetermined inserted position for positioning and locking the parts in assembled relation.

Other objects, features and advantages of the invention will become apparent from a reading of the specification when taken in conjunction with the drawings in which like reference numerals refer to like elements in the several views.

DESCRIPTION OF THE PREFERRED EMBODIMENT

Figure 1:
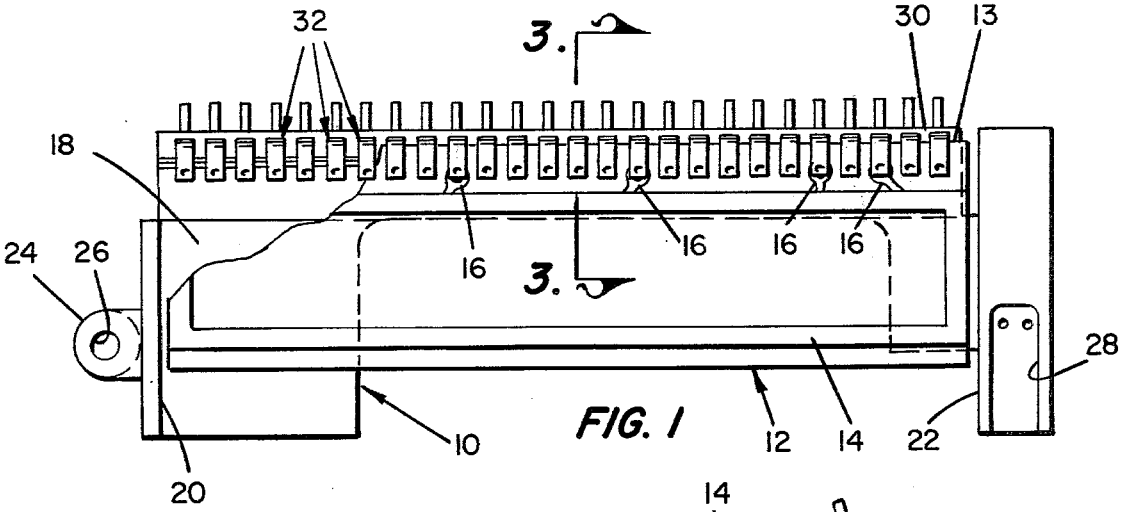
FIG. 1 is a plan view showing a printed circuit board display assembled to the connector according to the invention.

Referring now to the drawings and particularly to FIG. 1 there is shown a connector generally designated 10 having a printed circuit board generally designated 12 secured thereto, the printed circuit board 12 having a display 14 mounted therein (the numerals not being shown), which may be for example a light emitting diode array having a plurality of conductors terminating in conductive pads 16 adjacent one edge of the printed circuit board 12, the board 12 being of conventional configuration.

The connector 10 includes a body member 18 which has a generally planar surface with upwardly extending shoulder portions 20 and 22 in generally parallel relation for guiding the edges of the printed circuit board 12 during assembly. The shoulders 20 and 22 are formed integrally at opposite ends of the body member 18 and may have formed integrally therewith connecting means such as a boss 24 with an aperture 26 extending therethrough or a channel 28 configured for being retained by other means (not shown).

Adjacent one edge 30 of the body member 18 is a plurality of resilient or spring metal type contact members generally designated 32 (see also FIGS. 2 and 3), the contact members 32 being formed of a spring type brass or silver coated metal. Each contact member 32 has a main stem portion 34 which may be suitably detented such as at 36 for being molded into and retained within the body member 18 during formation thereof, the body member 18 being preferably formed of an insulating plastic composition material.

Each of the contact members 32 likewise has a soldering end 38 extending below the plane of the body member 18 and an upwardly extending generally J-shaped contact end 40 which is bent inwardly and downwardly toward the surface of the body member 18, the terminal end of contact end 40 preferably being provided with a downwardly extending protuberance or detent 42.

As better illustrated in FIG. 1, all of the contact members 32 have the stem portions 34 thereof in aligned relation in proximity to the rear edge 30 of the body member 18 with the terminal ends of the contact ends 40 thereof defining a line generally parallel to the edge 30.

Figure 2:
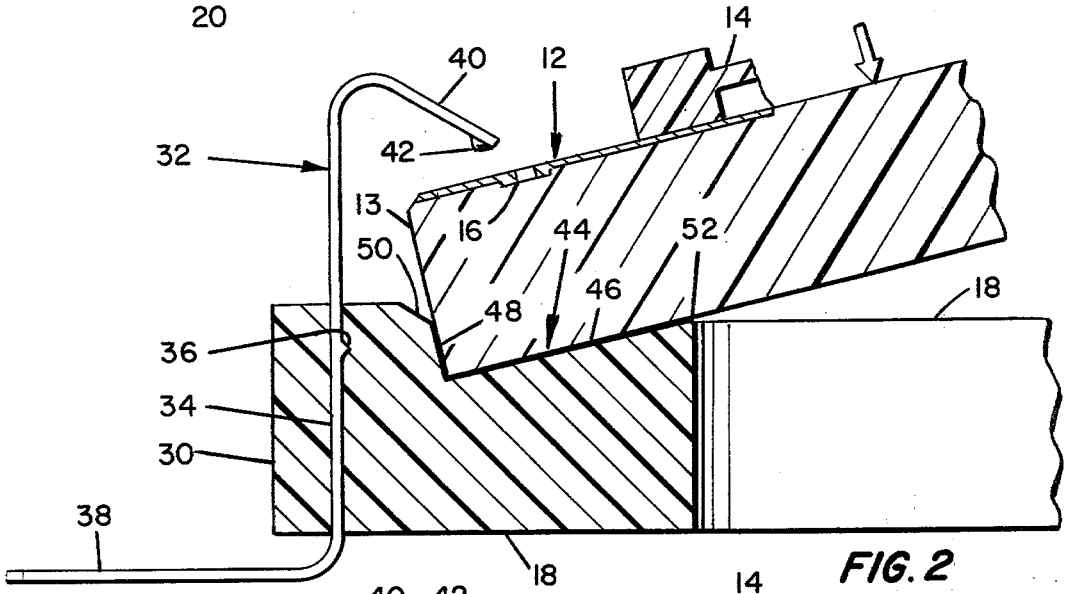
FIG. 2 is a cross sectional view of the connector of FIG. 1 illustrating the printed circuit board in partially assembled relation.
Figure 3:
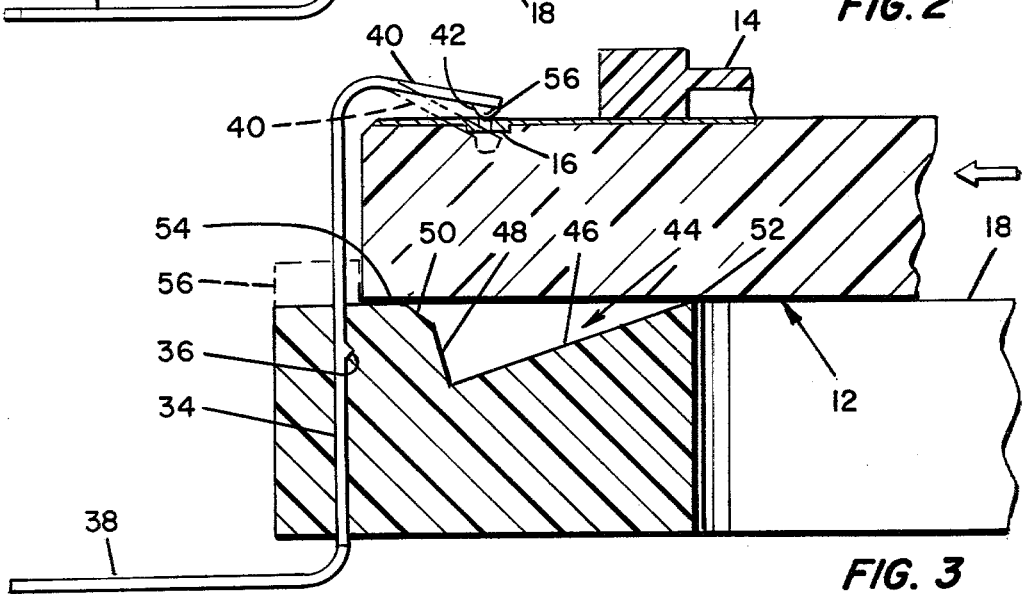
FIG. 3 is a cross sectional view of the connector and printed circuit board of FIG. 1 taken generally along Line 3—3 thereof.

As better illustrated in FIGS. 2 and 3, the spacing between the free end of the contact end 40 and the plane of the body member 18 defines an opening for receiving the edge 13 of the printed circuit board 12 with this opening being of slightly smaller dimension than the thickness of the plate-like portion of the printed circuit board 12 adjacent the edge 13.

Extending longitudinally and formed integrally within the body member 18 is a recess generally designated 44, the recess 44 having a bottom surface 46 angularly disposed relative to the plane of the body member 18 with an upwardly extending generally perpendicular end surface 48 and a tapered edge 50. The recess 44 extends generally parallel to the line formed by the aligned stem portions 34 of the contact members 32 with the angular disposition of the bottom surface 46 being inwardly and downwardly relative to the plane extending through the stem portions 34. The intersection of the end surface 48 and bottom surface 46 of recess 44 is spaced inwardly toward the stem portions 34 relative to the line defined by the free ends of the contact ends 40 of the contact members 32. As illustrated in FIG. 2, with this configuration, the recess 44 has a depth beneath the detent 42 a distance sufficient for insertion of the printed circuit board 12 without the upper surface thereof contacting or touching the detents 42. In this position, the edge 13 of the printed circuit board 12 is abutting against the end surface 48 of the recess 44 with the bottom of the printed circuit board 12 in abutting relation with the bottom surface 46 of recess 44.

As a downward or pivoting force is exerted in the direction of the arrow adjacent the right hand edge of the printed circuit board 12 in FIG. 2, the printed circuit board 12 acts as a lever and pivots about the fulcrum designated by the reference numeral 52, this fulcrum being the edge formed by the intersection of the bottom surface 46 of recess 44 with the plane of the body member 18. This pivoting action elevates the edges 13 of the printed circuit board 12 until the detents 42 engage the upper surface of printed circuit board 12 to thereby deflect the contact ends 40 upwardly to the solid line position illustrated in FIG. 3 from the dotted line normal position. As the printed circuit board 12 is then slid forward deeper into the opening, (in the direction of the arrow shown in FIG. 3) the lower corner of edge 13 of printed circuit board 12 engages the tapered edge 50 with further movement to the left as viewed in FIG. 3 causing the edge 13 of printed circuit board 12 to clear the tapered edge 50 to rest on a ridge portion 54 inwardly disposed within the opening adjacent the stem portions 34 of contact members 32, the printed circuit board 12 then resting in the position shown in FIG. 3 frictionally retained in abutting relation with the planar surface of body member 18 by means of a downwardly extending force exerted by the spring contact ends 40 of contact members 32. In this position, the detent 42 engages a recess 56 formed in the conductive pad 16 of the printed circuit board 12. In this assembled position, the edge 13 of the printed circuit board 12 is in spaced proximate relation to the stem portion 34 of the contact members 32. To facilitate positioning of the printed circuit board 12 the body member 18 may optionally be provided with a stop edge 56 (shown in dotted lines) for abuttingly engaging the edge 13 of printed circuit board 12 to limit the inward movement and eliminate contact with the upwardly extending stem portions 34. By utilization of the recess 44 the initial insertion of the edge 13 of printed circuit board 12 into recess 44 is virtually effortless due to the clearance between detents 42 and the adjacent surface of printed circuit board 12 as illustrated in FIG. 2. The pivoting of the printed circuit board 12 about the fulcrum 52 likewise minimizes the effort of deflection of the free ends of contact ends 40 with a very low insertion force being required to advance the printed circuit board 12 inwardly toward contact members 32 once the deflection is accomplished.

Figure 4:
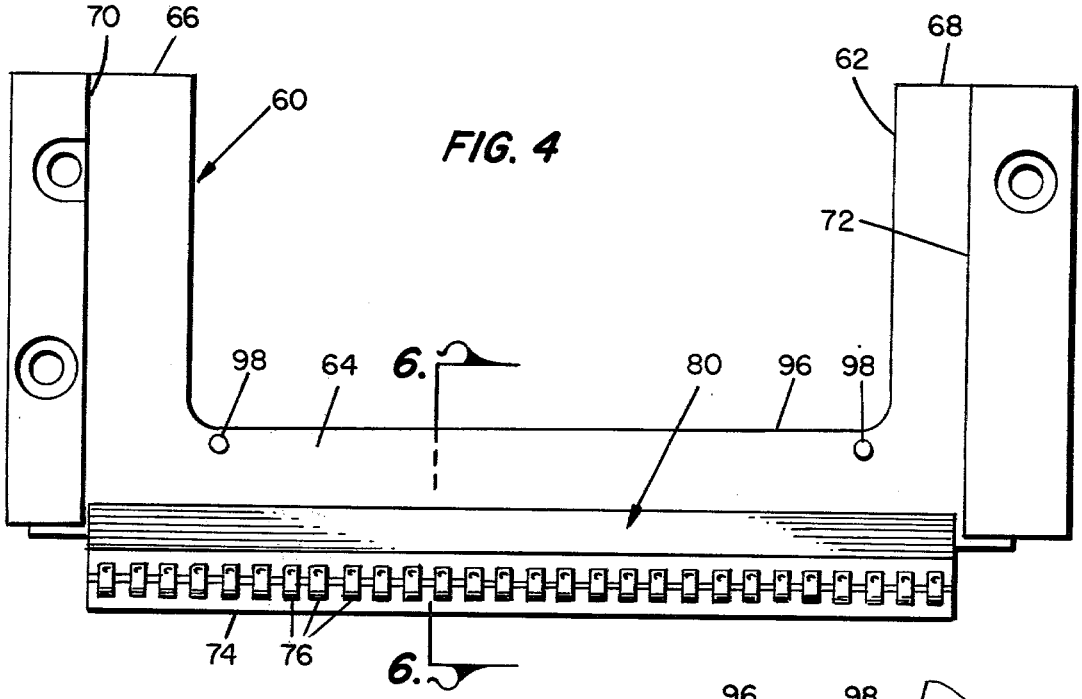
FIG. 4 is a plan view of another connector according to the invention.
Figure 5:
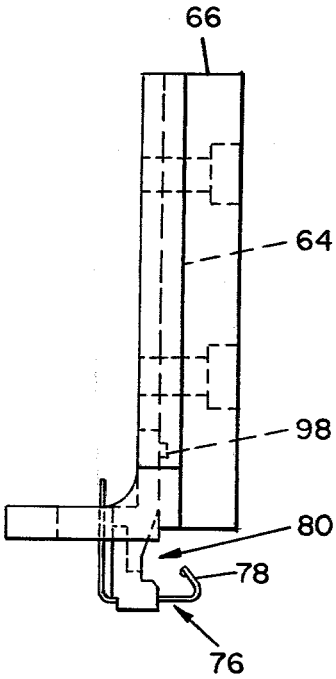
FIG. 5 is an end view of the connector of FIG. 4.
Figure 6:
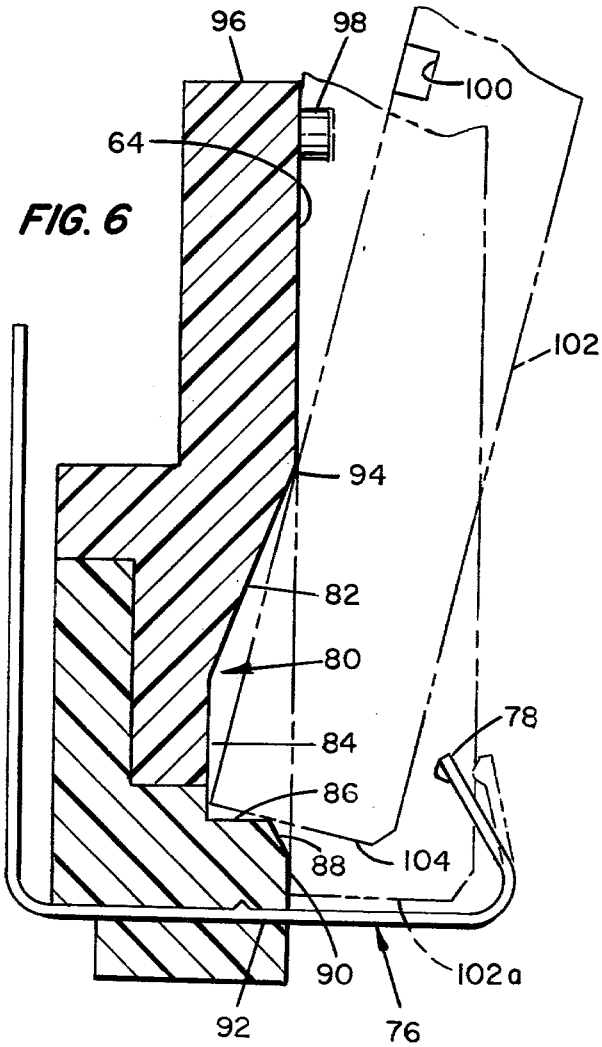
FIG. 6 is a cross sectional view of the connector of FIG. 4 taken along Line 6—6 thereof illustrating the insertion of a printed circuit board therein.

Referring now to FIGS. 4–6 an alternate embodiment of the connector is illustrated, the connector generally designated 60 being symmetrical as viewed in plan view in FIG. 4 with a cut-away portion 62 resulting in the body member 64 being generally U-shaped with the arms 66 and 68 thereof having integrally formed shoulders 70 and 72 respectively for acting as guide means for insertion of a printed circuit board or the like. The edge 74 of the body member 64 is provided with similarly aligned contact members 76 adjacent edge 74 with contact ends 78 bent inwardly and downwardly toward body member 64 with a longitudinally extending recess generally designated 80 formed thereunder. As best illustrated in FIGS. 5 and 6, the recess 80 in cross section is configured somewhat differently from the recess 44 of connector 10. The recess 80 is provided with a first downwardly extending surface 82 with a bottom surface 84 generally parallel to the plane of the surface of body member 64 with an end surface 86 extending generally perpendicular to the bottom surface 84. A tapered edge 88 completes the recess 80 with an adjacent ridge portion 90 coextensive with the plane of the body member 64 being adjacent the stem portions 92 of the contact members 76.

As can be seen by comparing FIG. 6 with FIGS. 2 or 3, the surface of the body member 64 rearwardly of the recess 80 is somewhat greater on the connector 60, extending rearwardly of the fulcrum 94 of body member 64. Adjacent the rear end 96 of body member 64 and formed integrally with the body member 64, there is a pair of projections 98 (see also FIG. 4) which are locking pins configured for engaging openings 100 formed in the printed circuit board 102. The openings 100 may be apertures or recesses matingly configured to the cross section of the projections 98 with the openings 100 being positioned from the leading edge 104 of printed circuit board 102 a distance sufficient to enable a locking or positioning of printed circuit board 102 in spaced proximate relation to the stem portions 92 of connector member 76 as illustrated in broken line position 102*a* in FIG. 6. This lock pin engagement may be utilized on other connectors with or without the recess 80. Furthermore, the connector 60 may be formed in one or two pieces assembled together. Similarly, the connector stem portions 92 may extend along a plane parallel to the surface of body member 64 with the contact ends 78 still extending in the same general direction as illustrated in FIG. 6.

Thus there has been shown and described a connector 10 and an alternate embodiment of connector 60 which are compact, readily assembled, with an integrally formed recess in spaced proximate relation to the contact ends for providing a low insertion force during assembly of a printed circuit board thereto. Furthermore the projections 98 and openings 100 in the alternate embodiment provide a positive positioning and locking of the parts in assembled relation, the projections 98 being positioned a distance sufficient from the fulcrum 94 so that the lower corner of edge 104 is in engagement with the tapered edge 88 during the last increment of travel required for co-action of the projection 98 within opening 100. While there has been shown and described a preferred embodiment it is to be understood that various other adaptations and modifications may be made within the spirit and scope of the invention.

What is claimed is:

1. In an electrical connector adapted for receiving printed circuit boards or the like having a predetermined thickness and having an edge thereof including a plurality of generally planar electrical contact portions, the combination comprising:

a body member having a generally planar portion;

a plurality of substantially identical aligned resilient contact members extending through said body member, each of said contact members being generally J-shaped with a stem portion thereof extending through the planar portion of said body member and a free end portion projecting back towards the planar portion of said body member, the terminal ends of the end portions defining a line parallel to the planar portion of the body member, each of the terminal ends being adapted to make electrical contact with a respective one of the contact portions of the printed circuit board, with the spacing between the defined parallel line and the planar portion of the body member defining an opening to receive the edge of the printed circuit board, the opening having a smaller dimension than the thickness of the printed circuit board;

a recess formed in said planar portion below said line, said recess having sufficient depth and being configured for receiving said edge with the board thereof angularly disposed relative to said planar portion with said edge in non-touching relation relative to the terminal ends of said contact members, pivoting of said board toward said planar portion bringing the electrical contact portions of said edge into abutting relation with the terminal ends of said contact members; and a ridge portion of said body member adjacent said recess, said ridge portion being so positioned that movement of the edge of said board into said opening retains at least a portion of said edge on said ridge portion with said board in abutting relation with the planar portion said body member.

2. The combination according to claim 1 wherein said recess includes a tapered portion contiguous to said ridge portion for guiding said edge into said opening.

3. The combination according to claim 2 wherein said recess includes a generally planar bottom surface angularly disposed relative to said planar portion, the intersection of said bottom surface and said planar portion forming a fulcrum for pivoting the board.

4. The combination according to claim 3 wherein said recess further includes a tapered portion contiguous to said ridge portion for guiding the edge of said board onto said ridge portion after pivoting of the board.

5. The combination according to claim 4 wherein said contact members are generally J-shaped with the stem portion thereof extending through said body member in generally perpendicular relation to said planar portion.

6. The combination according to claim 1 wherein said body member includes means for engaging a portion of the printed circuit board for fixedly positioning the printed circuit board relative to said body member with the edge of said board in said opening.

7. The combination according to claim 6 wherein said means for engaging a portion of the board includes a plurality of projections spaced from said recess.

8. The combination according to claim 7 wherein said projections are a pair of pin members formed integrally with said body member, each of said pin members being positioned equadistant from said recess.

9. The combination according to claim 8 wherein said body member further includes shoulder portions in generally parallel relation and positioned for guiding the printed circuit board into said opening.

* * * * *